US008136270B1

(12) United States Patent
Wammock

(10) Patent No.: US 8,136,270 B1
(45) Date of Patent: Mar. 20, 2012

(54) GRAVE DIGGING SYSTEM

(76) Inventor: Johnny E. Wammock, Langley, SC (US)

( * ) Notice: Subject to any disclaimer, the term of this patent is extended or adjusted under 35 U.S.C. 154(b) by 0 days.

(21) Appl. No.: 12/821,619

(22) Filed: Jun. 23, 2010

Related U.S. Application Data

(60) Provisional application No. 61/220,301, filed on Jun. 25, 2009.

(51) Int. Cl.
*E02F 3/04* (2006.01)

(52) U.S. Cl. ..... 37/300; 414/726

(58) Field of Classification Search ..... 37/304, 37/443, 300–303, 403–410, 195, 466; 414/460, 414/724–726, 624, 626, 739; 212/180, 181
See application file for complete search history.

(56) References Cited

U.S. PATENT DOCUMENTS

| | | | | | |
|---|---|---|---|---|---|
| 2,028,442 | A | * | 1/1936 | Dormer | 27/32 |
| 2,444,690 | A | * | 7/1948 | Almendinger et al. | 414/460 |
| 2,562,189 | A | * | 7/1951 | Harris | 414/461 |
| 2,602,400 | A | * | 7/1952 | Haase | 104/126 |
| 2,624,129 | A | * | 1/1953 | Steece | 37/95 |
| 2,754,977 | A | * | 7/1956 | Przybylski | 212/238 |
| 3,015,175 | A | * | 1/1962 | Smith | 37/300 |
| 3,107,444 | A | * | 10/1963 | Crum et al. | 37/300 |
| 3,298,539 | A | * | 1/1967 | Sundstrom | 212/288 |
| 3,372,819 | A | * | 3/1968 | Kellogg | 414/461 |
| 3,524,510 | A | * | 8/1970 | Connell | 175/88 |
| 3,550,294 | A | * | 12/1970 | Fewell | 37/300 |
| 3,577,664 | A | * | 5/1971 | Sing et al. | 37/300 |
| 3,861,544 | A | * | 1/1975 | Carter | 414/460 |
| 3,987,563 | A | * | 10/1976 | Baur | 37/345 |
| 4,049,138 | A | * | 9/1977 | Soyland | 414/687 |
| 4,063,374 | A | * | 12/1977 | Washington | 37/142.5 |
| 4,085,531 | A | * | 4/1978 | Aubert | 37/190 |
| 4,194,311 | A | * | 3/1980 | Thames | 37/300 |
| 4,310,975 | A | * | 1/1982 | Bibaut | 37/341 |
| 4,378,958 | A | * | 4/1983 | Mauldin | 414/461 |
| 4,497,608 | A | * | 2/1985 | Sheppard et al. | 414/726 |
| 5,393,193 | A | * | 2/1995 | Dagg | 414/540 |
| 5,720,400 | A | * | 2/1998 | Altizer, Sr. | 212/180 |
| 5,809,625 | A | * | 9/1998 | Young et al. | 27/32 |
| 5,908,279 | A | * | 6/1999 | Mote | 414/542 |
| 6,129,226 | A | * | 10/2000 | Donovan | 212/300 |
| 6,419,440 | B1 | * | 7/2002 | Smith | 414/460 |
| 6,966,448 | B1 | * | 11/2005 | Burkett | 212/180 |

FOREIGN PATENT DOCUMENTS

DE 3145580 * 5/1983

* cited by examiner

*Primary Examiner* — Robert Pezzuto
(74) *Attorney, Agent, or Firm* — Smith Moore Leatherwood LLP; Thomas W. Epting

(57) ABSTRACT

A method and self-propelled system for digging a grave. The system includes a frame defining a frame opening positionable over a grave site and a motor connected to the frame. Wheels connected to the frame to allow for movement of the frame about a surface. A generally zero radius turn mechanism connected to the wheels allows the frame to make generally zero radius turns. An excavator is connected to the frame and is configured for operation through the frame opening to dig a grave. A hoist is attached to the frame and lowers a container within the grave. Containers are attached on each side of the frame and receive dirt excavated by the excavator. Outriggers attached to the frame stabilize the frame during operation of the hoist and the excavator. An operator's seat and controls are also attached to the frame.

13 Claims, 10 Drawing Sheets

GRAVE DIGGING SYSTEM

BACKGROUND

This application claims benefit of U.S. Provisional Application Ser. No. 61/220,301, filed Jun. 25, 2009, and the entirety of such application is incorporated herein by reference.

This invention relates generally to a system for excavation of a hole, placement of an item in the hole, and backfilling the hole, and more specifically, to a system for digging graves, which may include transport of container such as a casket or vault to the grave site, excavation of a grave for receipt of the container, lowering of the container into the grave, and subsequently backfilling the grave.

Accomplishing the burial of a person's remains can be a labor and/or equipment-intensive endeavor, potentially requiring multiple workers and multiple pieces of equipment. For example, a backhoe or tractor may be needed at the grave site to dig the grave, and a truck and/or trailer may be needed for transport of the backhoe and the casket and/or vault to the vicinity of the grave site. Additionally, multiple workers may be required to operate such equipment, which can result in increased labor costs, personnel issues, etc. Further, use of various pieces of equipment can potentially increase equipment costs, logistics issues, maintenance issues, etc.

SUMMARY OF THE INVENTION

Generally, a preferred embodiment of the present invention includes a method and a system for excavation of a hole, placement of an item in the hole, and back filling the hole.

More specifically, at least one embodiment of the present invention includes a system for digging a grave at a grave site, comprising an elongated frame defining a frame opening of an area that is generally at least as large as the area of the grave and that is positioned over the grave site, and a motor that is connected to the frame. Wheels may be connected to the frame to allow for movement of the frame about a surface, with the motor being connected to the wheels for selectively providing motive force to the wheels to move the frame about such surface. Connected to the frame is an excavator configured for generally digging the grave via operation in the frame opening.

The foregoing system for digging a grave may also include a hoist attached to the frame that lifts and lowers a container within the grave.

Also, the foregoing system for digging a grave may include outriggers for stabilizing the frame during operation of the hoist and of the excavator.

Further, the foregoing system for digging a grave may also include at least one container for receiving dirt excavated by the excavator and for holding such dirt as the frame is moved about the surface.

Additionally, the foregoing system for digging a grave may include a generally zero radius turn structure connected to the wheels that allows the frame to make a generally zero radius turn when moving about a surface.

The present invention also includes a method of digging a grave at a grave site comprising positioning an opening, defined by a frame, of an area generally at least as large as the area of the grave over the grave site, and digging the grave via the opening using an excavator connected to the frame. The method further includes lowering a container into the grave using a hoist connected to the frame.

The foregoing method may also include placing dirt generated during the excavation of the grave in a container attached to the frame and dumping the dirt from the container to backfill the grave.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF PREFERRED EMBODIMENTS

Figure 1:
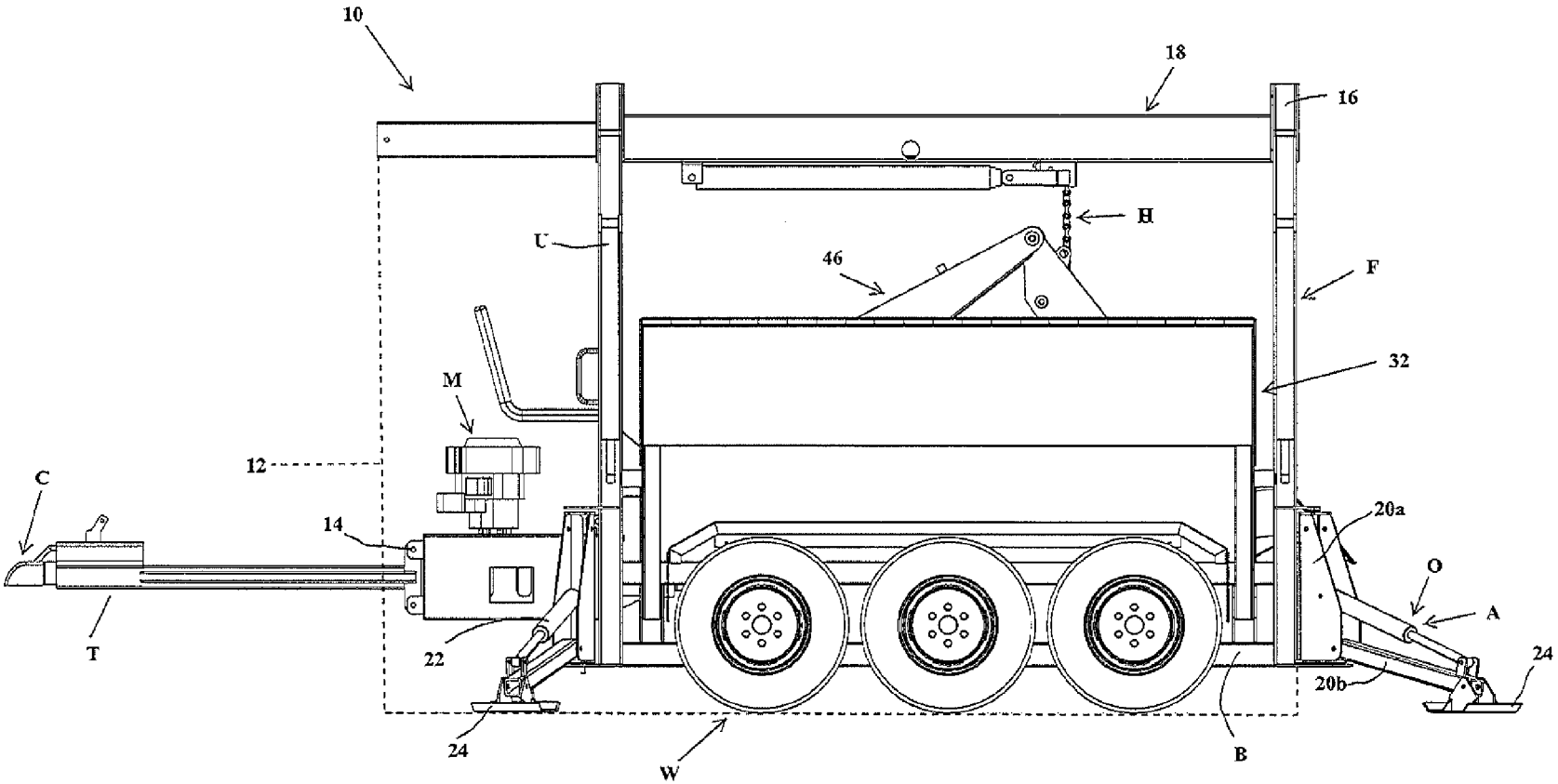
FIG. 1 is a front elevational view of a grave digging system constructed in accordance with the present invention.

The accompanying drawings and the description which follows set forth this invention in several of its preferred embodiments. However, it is contemplated that persons generally familiar with digging and excavation equipment and systems will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the grave digging system of the present invention is indicated generally in the figures by reference character 10.

In one of various preferred embodiments, grave digging system 10, also referred to herein as "grave digger system 10," or "system 10," is self-propelled and is capable of lifting and transporting a container, generally C (FIG. 2), such as a vault, generally V, or casket (not shown), to a grave site, digging the grave, generally G (FIG. 10), at the grave site, lowering container C into the grave G, and backfilling the grave (FIG. 5) to cover the container. System 10 can be operated by one worker, if desired.

Turning to FIG. 1, one preferred embodiment of grave digging system 10 is shown. System 10 includes a frame, generally F, to which wheels, generally W, are attached for rotation. Although six W wheels are shown, it is understood that more or less wheels W could also be used, if desired. For example, in certain applications, system 10 may include four wheels instead of six. A retractable cover or awning, generally 12, could be provided to system 10, if desired, to cover system 10 during storage, during periods of inactivity, during transport, and/or during use, if desired.

Figure 9:
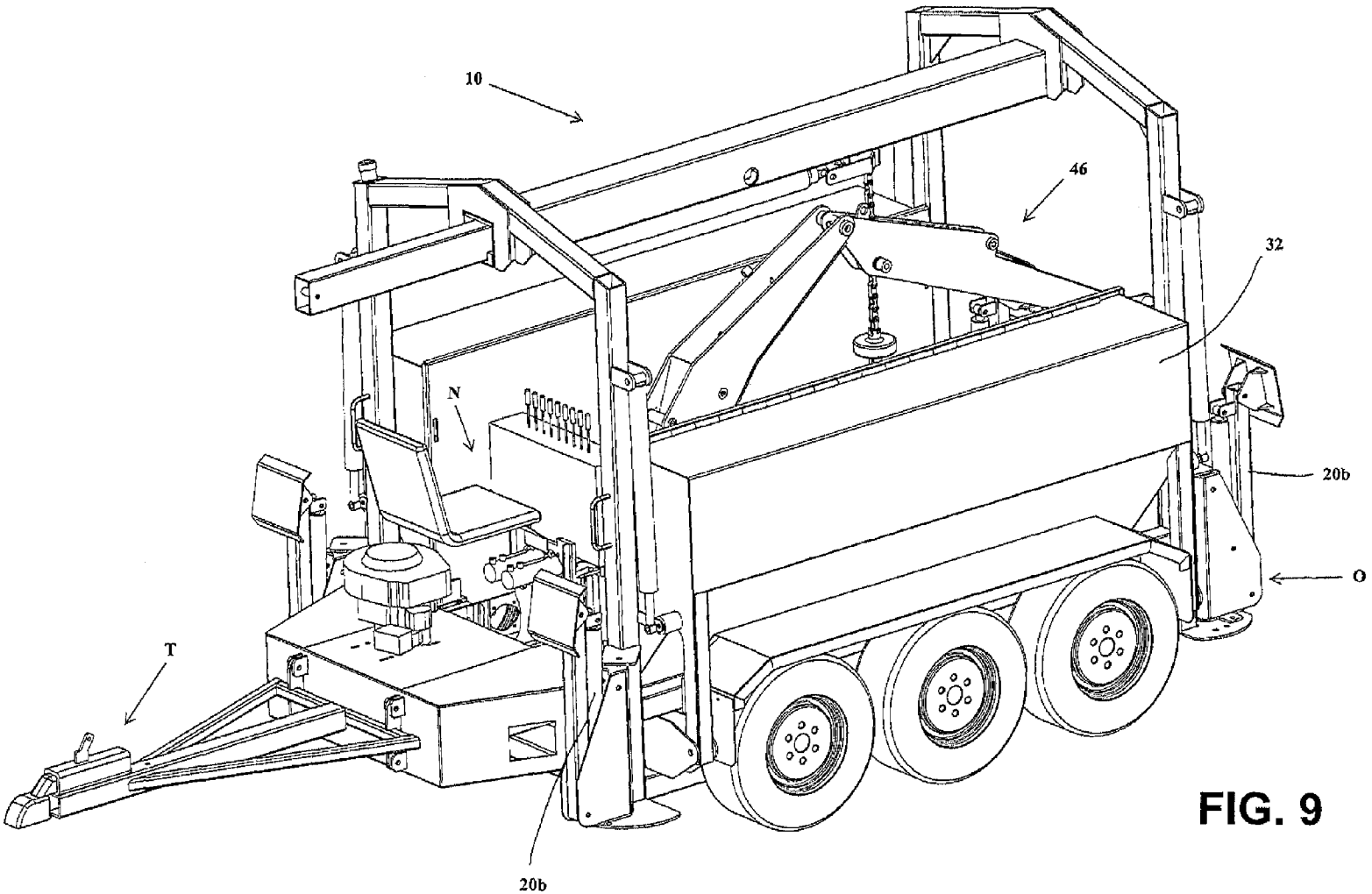
FIG. 9 is a perspective view of the grave digging system illustrated in FIG. 1.

Extending outwardly from the front of frame A is a tongue structure, generally T, which allows system 10 to be towed by a tow vehicle (not shown). Tongue T is pivotable about pivot points or pins 14, and includes a coupling, generally C, for attaching tongue T to a tow vehicle. Although not shown, a spring and/or hydraulic or pneumatic cylinder assist could be attached to tongue T to facilitate raising and lowering tongue T during pivoting of tongue T. Frame F includes uprights, generally U, extending upwardly from a base portion B of frame F. The upper ends of uprights U are connected by bridging portions 16, which serve to support a longitudinally extending boom, generally 18, which runs generally the length of frame F. Pivotally connected to uprights U are outriggers, generally O, which may be pivoted about the longitudinal axes of uprights U. Outriggers O each include an upper arm 20*a*, and a lower arm 20*b* pivotally connected to the upper arm 20*a*. An actuator, generally A, such as a hydraulic and/or pneumatic cylinder 22, is provided for moving the lower arm 20*b* of each actuator A between a lowered position, as shown in FIG. 1, and a raised, transport position, as shown in FIG. 9. Pivotally connected to the end of each lower arm 20*b* is a ground, or other surface, engaging foot 24, such that when outriggers O are extended and lower arms 20*b* lowered, outriggers O serve to stabilize system 10.

Figure 10:
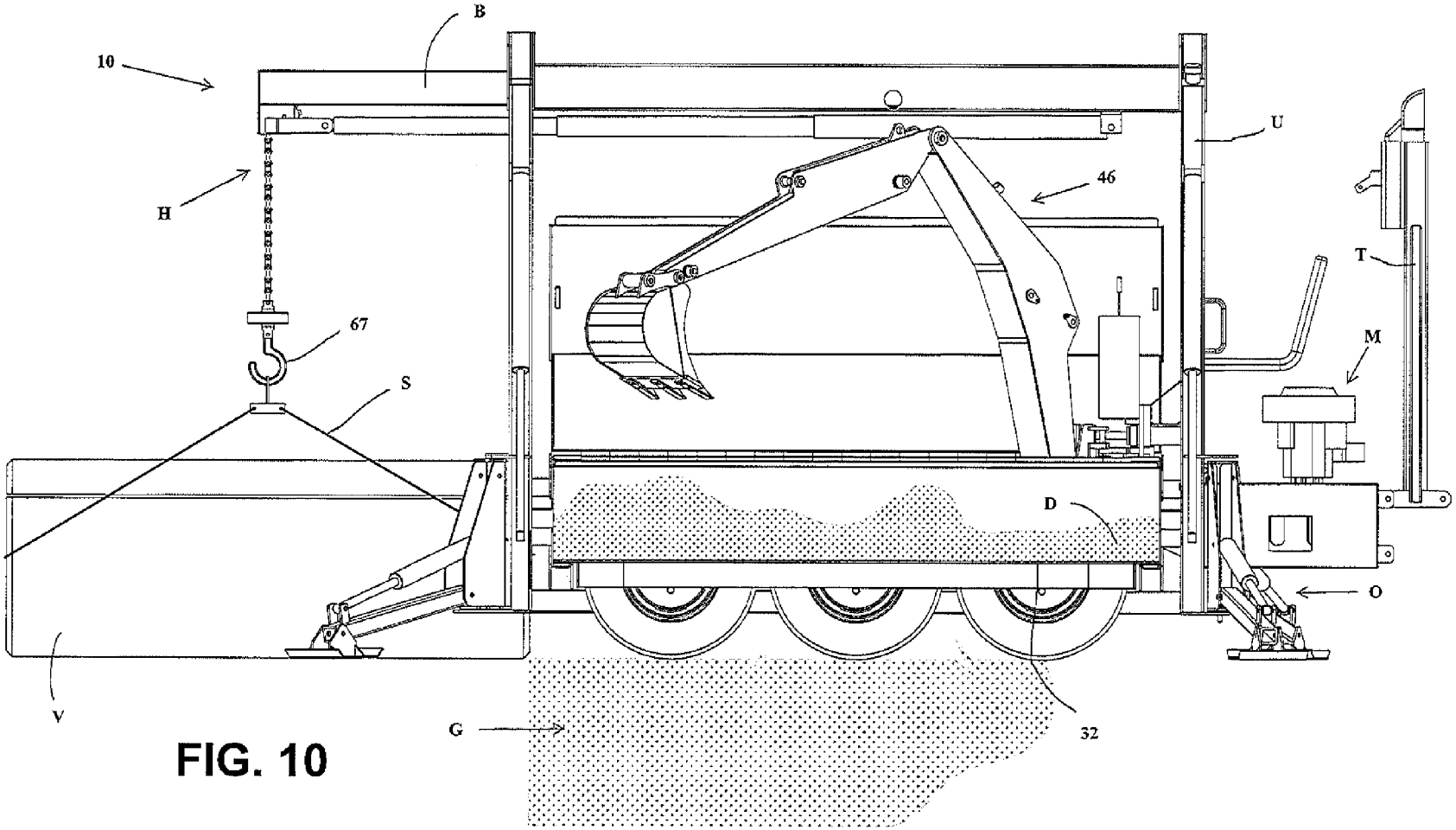
FIG. 10 is a rear elevational view of the grave digging system constructed in accordance with the present invention, showing the excavator system in use digging a grave.

As shown in FIG. 1, tongue T is in its lowered position, i.e., the position it assumes when system 10 is to be towed. FIG. 10 illustrates tongue T in its raised position, which would ordinarily be the case when system 10 is being driven under its own power about an area, such as a cemetery. A motor, such as a diesel or gasoline engine, electric motor, or the like, generally M, is provided for operating powered equipment on system 10 and for also providing the motive force for driving system 10 about an area, such as a cemetery, using wheel motors (not shown) for powering wheels W. Such wheel motors could be hydraulic motors, powered by a hydraulic pump (not shown) which could, in turn, be powered by motor M, or could be electric motors, pneumatic motors, etc.

Pivoting dirt bins, or boxes, generally 32, are also provided along each side of system 10 and are configured for carrying and dumping dirt, generally D (FIGS. 3, 5, 8, and 10) in a manner discussed in more detail below. A hoist mechanism, generally H, is provided on boom 18 and can be provided to move with boom 18 and/or independent of boom 18 in order to lift and lower objects, such as a vault V, container C, casket, or the like, and also other equipment or articles as may be (FIG. 5) desired. Hoist H could be a manual hoist, if desired, and could use a block and tackle arrangement.

Figure 2:
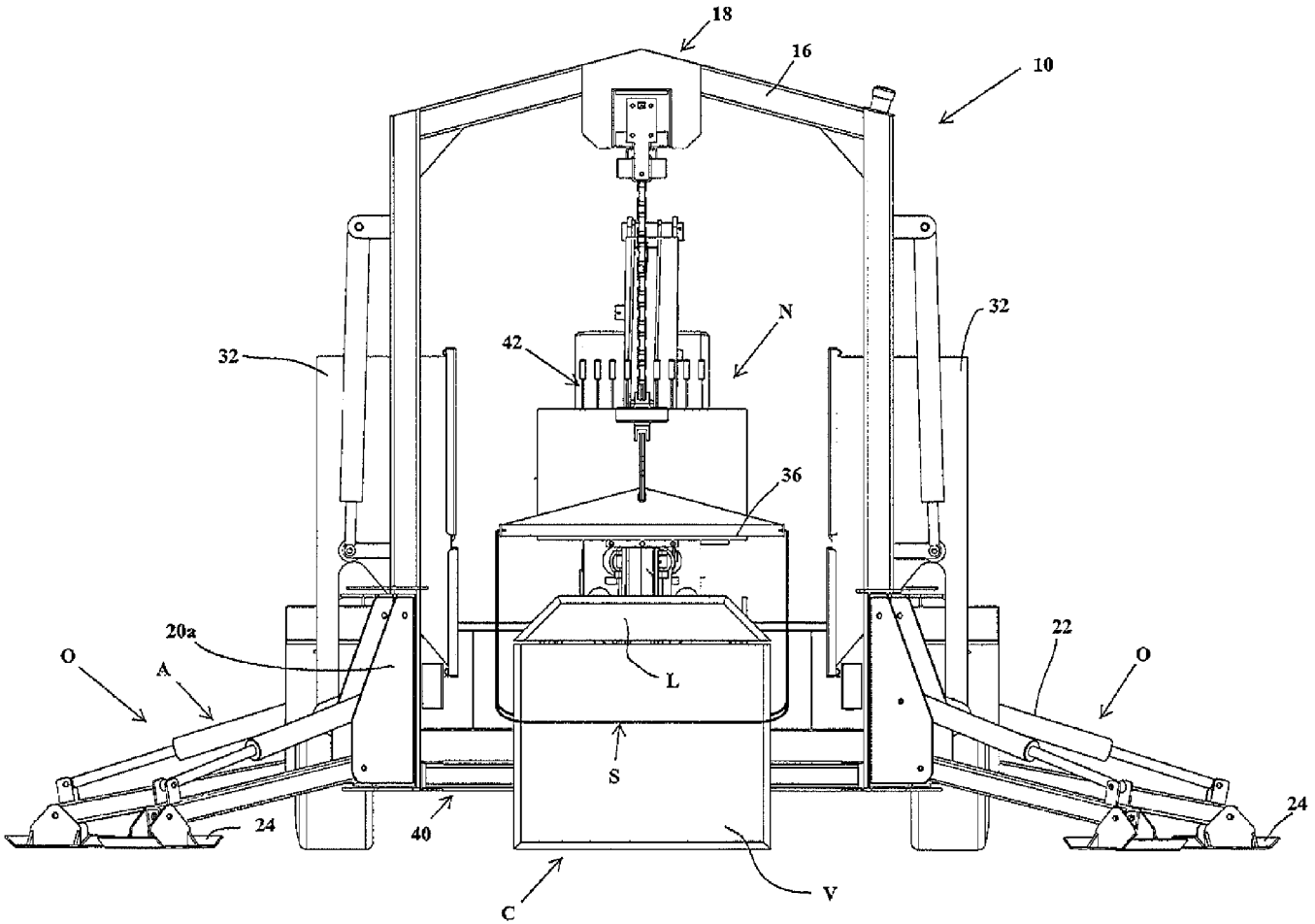
FIG. 2 is a right side elevational view of the grave digging system shown in FIG. 1, and includes an illustration of a container, such as a vault or casket, resting on a surface, such as the ground.

Turning now to FIG. 2, system 10 is shown configured for lifting vault V, which includes a lid, generally L. Hoist H includes a lift mechanism having a chain 34 connected to a transverse spreader, generally 36, from which cables, straps, ropes, or the like, generally S, are provided for lifting vault V and other objects. Note that outriggers O are extended with feet 24 engaging the ground or other surface. Note also that dirt boxes 32 are on edge, in a vertical, or upright, position along each side of a central opening 40 of system 10. FIG. 2 also provides a view of the operator's console, generally N, having controls, generally 42, for allowing system 10 to be driven, turned, and braked, and also for controlling other equipment and features of system 10, including operation of outriggers O, advancement and retraction of boom 18, operation of hoist H, operation of dirt bins 32, operation of backhoe 46 (FIG. 8), etc.

Figure 3:
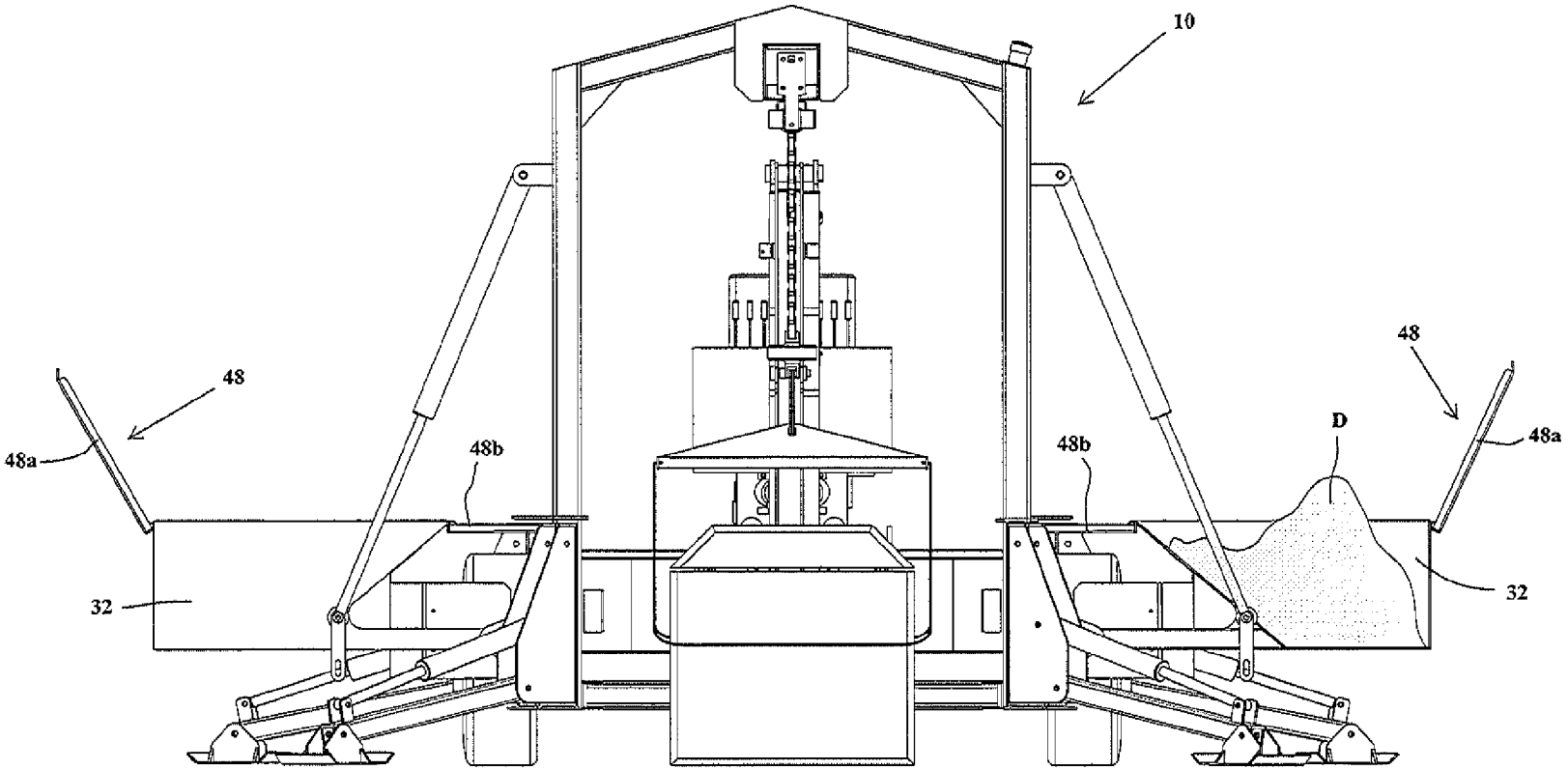
FIG. 3 is a right side elevational view of the grave digging system shown in FIGS. 1 and 2, having containers for dirt, such as bins, or boxes, in an extended position and containing dirt.

FIG. 3 illustrates dirt bins 32 pivoted to their horizontal, loading position, wherein the lids, generally 48, thereof have been pivoted to an open position, and with dirt D, being provided in at least one of bins 32. Covers or lids 48 may each include two portions, 48*a* and 48*b*. Portion 48*a* is wider than portion 48*b*, with portion 48*b* acting as a chute during dumping of dirt D into grave G. Lid portions 48*a* and 48*b* may overlap one another, in one embodiment, when lid 48 is in the closed position to facilitate closure of bins 32 and to thereby reduce the likelihood of dirt D escaping from the bins 32 during transport. The dirt in this situation could have been placed there by backhoe 46 during digging of a grave or other hole. Alternately, dirt D could be in a bin 32 as backfill material waiting to be returned to the grave G or a hole being dug.

Figure 4:
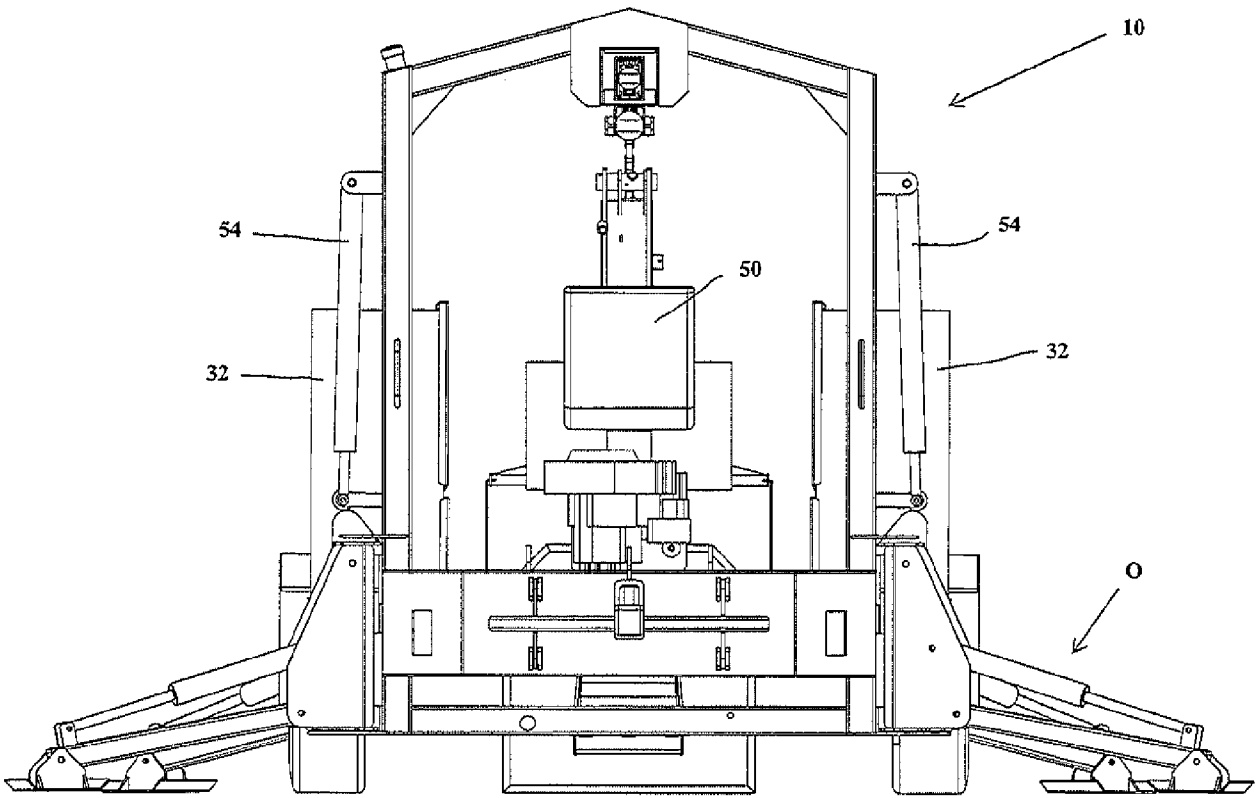
FIG. 4 is a left side elevational view of the grave digging system shown in FIG. 1.

FIG. 4 is a view of system 10 from the rear. From this vantage point, the operator's seat 50 can be seen as well as the operator's console N.

Figure 5:
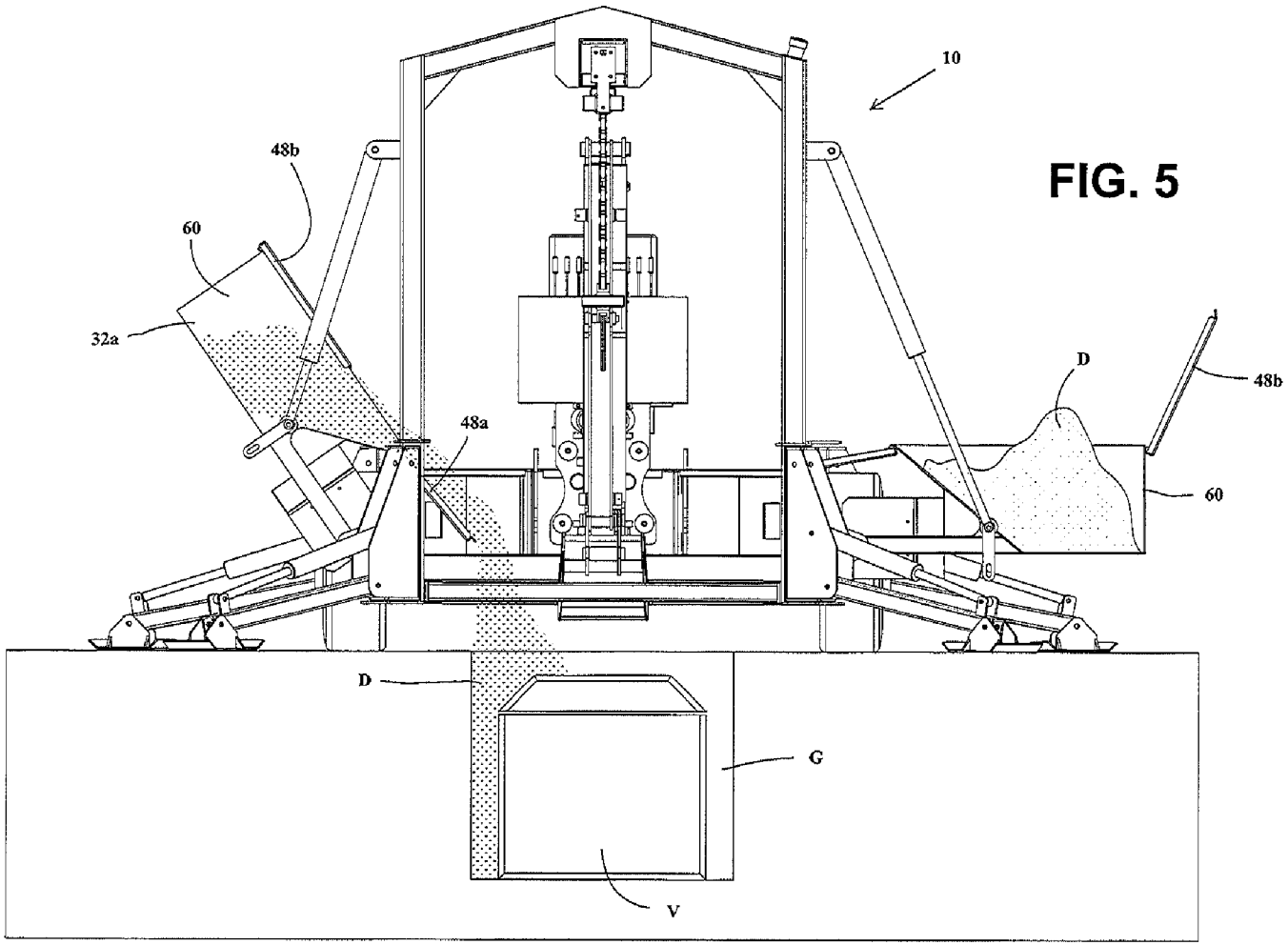
FIG. 5 is a right side elevational view of the grave digging system shown in FIGS. 1 and 4 positioned over a grave, with a container therein, and with a dirt bin in a dumping position for dumping dirt into the grave during backfilling of the grave.

FIG. 5 illustrates system 10 in a backfilling configuration, wherein grave G has been dug, and vault V being put in place within the grave. Dirt D is being released from dirt box 32, with a lid portion 48*a* acting as a chute for guiding dirt being discharged from bin 32 into the grave. The configuration of such chute facilitates backfilling of grave G by guiding dirt D into grave G. Bin 32*a* on the other side of system 10 is operable in a similar manner. In FIG. 5, bin 32 has been raised to the tilting position via one or more actuators 54, which could be hydraulic, pneumatic, or some other mechanical arrangement such as gears, chains, belt drive arrangements, etc. (not shown), if desired.

In one embodiment, dirt bins 32 are each approximately one cubic yard in capacity. Because a standard burial vault displaces approximately two cubic yards, the one cubic yard capacity of each bin would allow the operator (not shown) to have a good approximation of when an adequate amount of dirt has been discharged into the grave to compensate for the displacement of soil of the vault. When the level of dirt remaining in each bin approximates the height of its sidewalls, generally 60, of each bin 32, the operator will know that an approximate adequate amount of dirt has been backfilled into the grave to compensate for the amount of dirt displaced by the vault. The lids, or cover members, 48 of each bin could then be moved to their position for covering the bins, and such bins 32 could be moved to their generally upright position during moving of system 10 about and/or from the cemetery. Locking mechanisms can be provided (not shown) to lock cover member 48 closed during transport.

Figure 6:
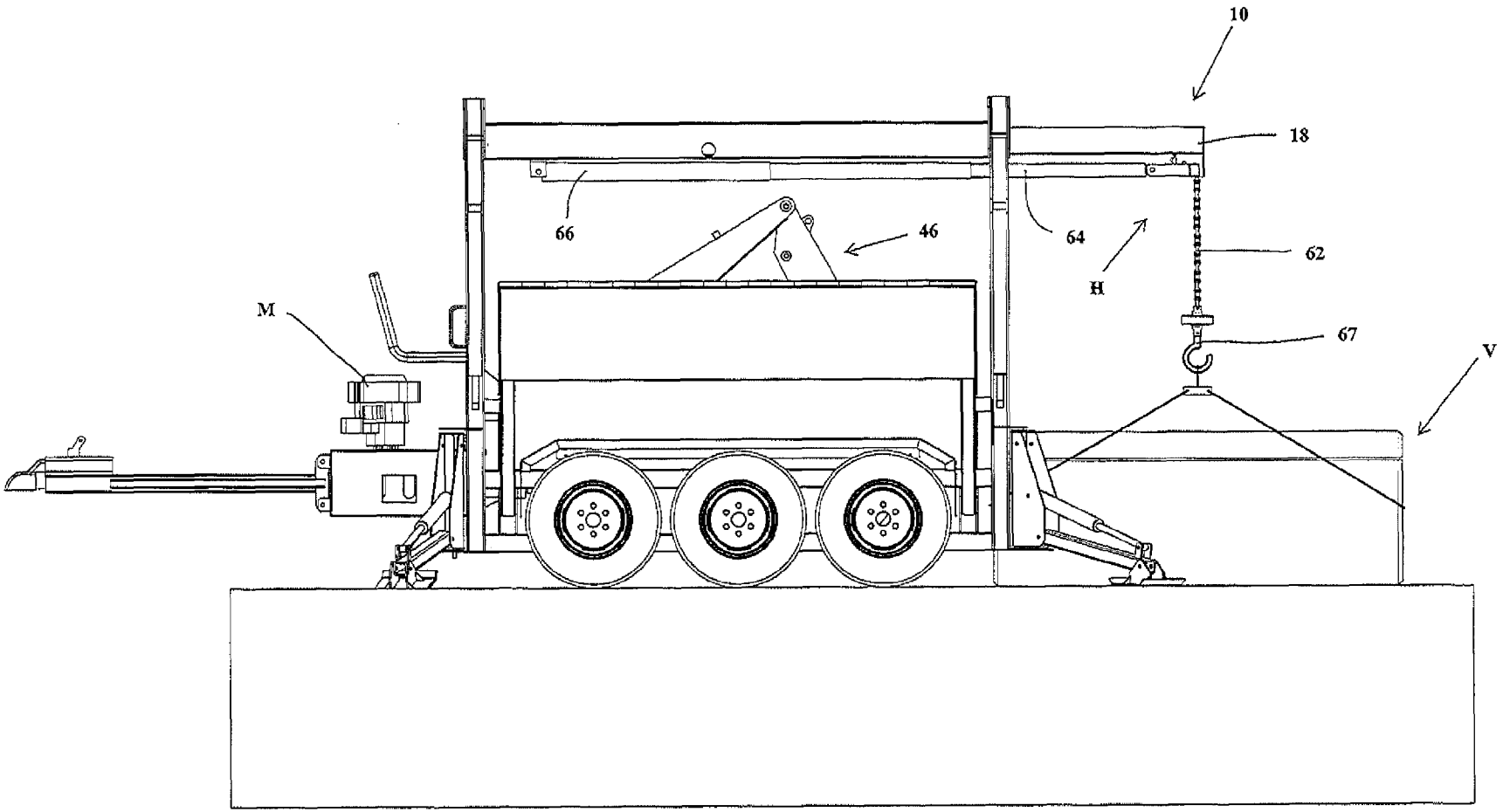
FIG. 6 is a front elevational view of the grave digging system illustrated in FIG. 1, with a boom extended for lifting a container.

FIG. 6 illustrates system 10 configured for lifting vault V from the ground. Hoist H includes a chain 62 connected to the shaft 64 of an actuator, generally 66, such as a hydraulic cylinder, pneumatic cylinder, or the like, such that retraction of such shaft 64 causes chain 62 to lift vault V upwardly, using hook 67, and such that extension of shaft 64 from actuator 66 would cause hoist H to lower the vault. Alternately, if desired, shaft 62 could be stationary, and actuator 66 configured to move with respect to shaft 64 upon pressurization and depressurization of actuator 66. In such an embodiment, chain 62 would be fixed to actuator 66. It is to be understood that motor M can provide the motive force for one or more hydraulic pumps (not shown) which may be used to operator the backhoe, hoist H, actuators 22, 54, and wheel motors, etc., and for auxiliary hydraulic powered equipment, such as cutters, jackhammers, lifts, motors, etc. (none shown). In addition to, or instead of, such hydraulic pump(s), one or more air compressors (not shown) could be provided for operating one or more of the foregoing items using compressed air, if desired.

Figure 7:
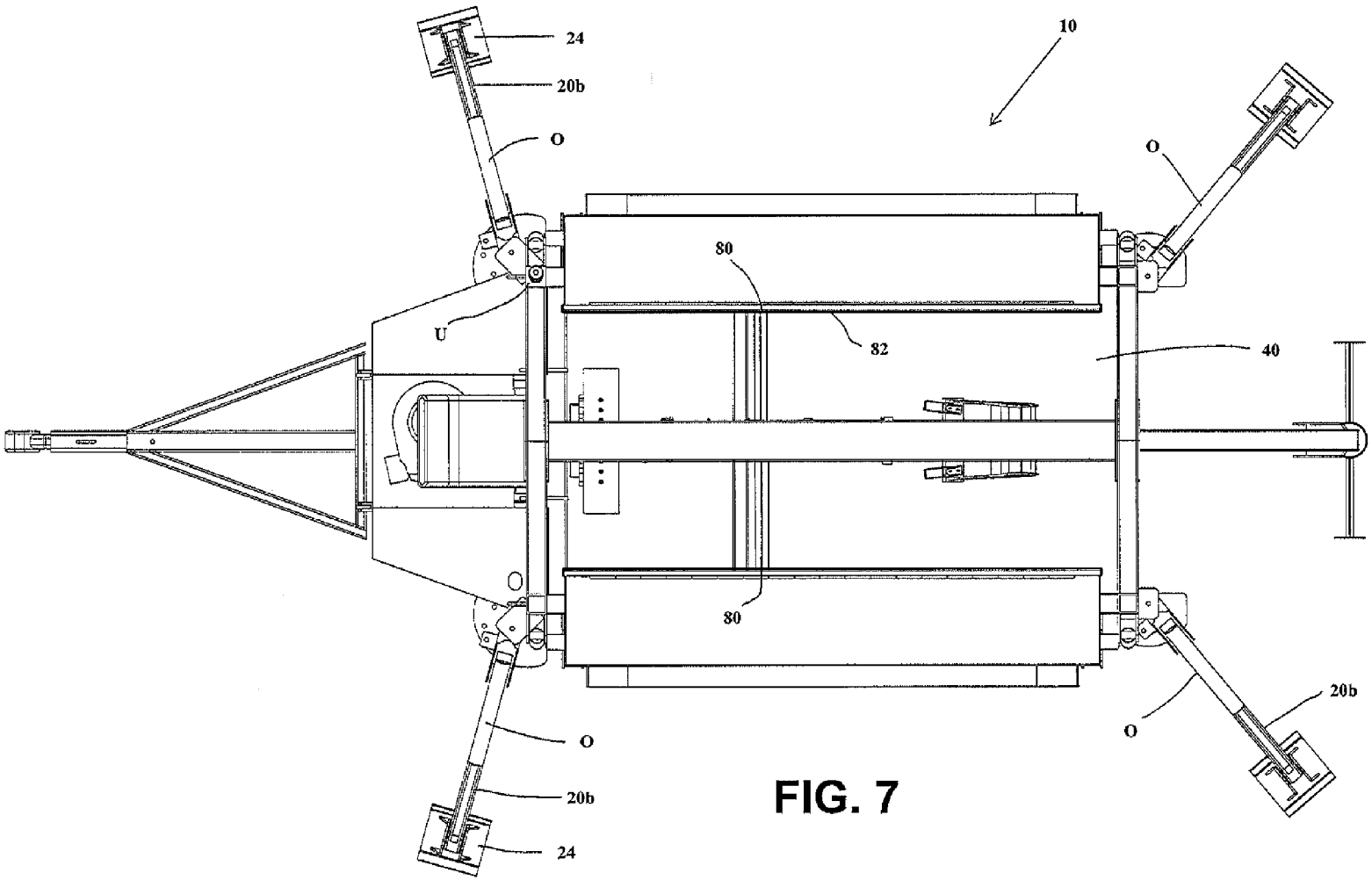
FIG. 7 is a plan view of the grave digging system illustrated in FIG. 1.

FIG. 7 illustrates system 10 with lower arms 20*b* of outriggers O being in their lowered positions. Note that outriggers O may be pivoted about uprights U to a position such that the pivotal feet 24 thereof provide optimal contact with the soil or other surface for supporting and stabilizing system 10. Pivoting of outriggers O also allows feet 24 to be positioned in a manner to not disturb of damage items on the ground, such as grave headstones, water lines, electrical utilities, masonry works (none shown). Further, the ability to pivot outriggers O allows for certain obstacles to be avoided, such as trees, walls, posts, columns, structures, etc. (none shown).

Figure 8:
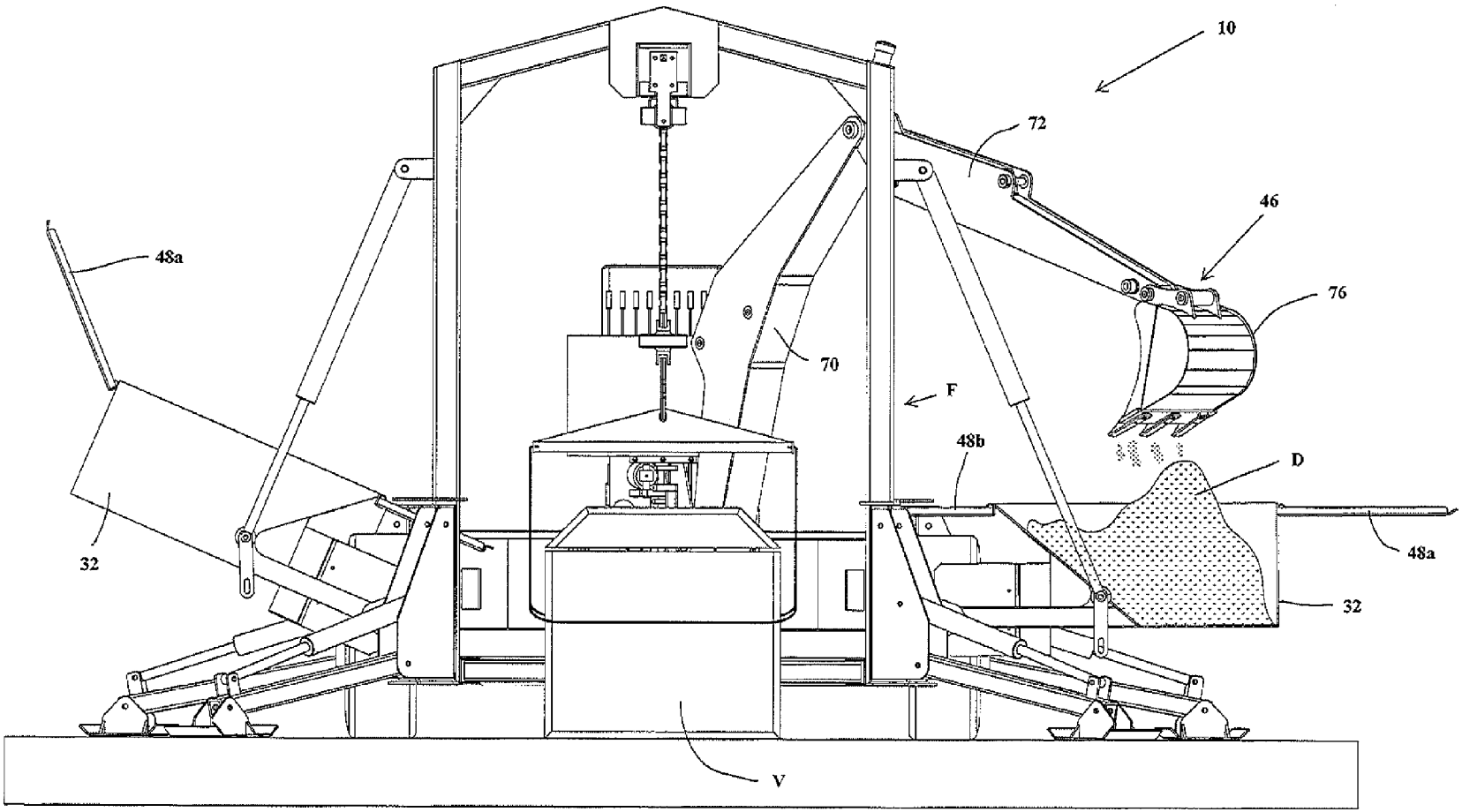
FIG. 8 is a right side elevational view of the grave digging system illustrated FIGS. 1, 2, and 3, wherein an excavator system is shown in use manipulating dirt from a grave.

FIG. 8 illustrates backhoe 46 in operation digging a grave or hole. Backhoe 46 could be powered by motor M and includes a lower arm 70, which is pivotable with respect to frame F, and which includes an upper arm 72, which is pivotable with respect to lower arm 70. A bucket 76 is in turn is pivotally connected to upper arm 72 and is actuated for digging, backfilling, tamping, scraping, and other purposes. Bucket 76 is powered by one or more actuators (not shown) which could be hydraulic cylinders, pneumatic cylinders, a combination thereof, or some other suitable motive means (none shown). The operator can use bucket 76 to dig a grave G through and beneath the central opening 40 of system 10, and the dirt lifted from the ground during such digging can be deposited in dirt boxes 32, as shown in FIG. 8. As shown in FIG. 7, central opening 40 defined by frame F is of an area generally at least as large as the surface area of the grave being dug, to provide clearance for operation of backhoe 46 to dig the grave. In this configuration, cradles 80 (which are movable along tracks 82) have been moved along track 82 to clear opening 40, to thereby allow operation of backhoe 46 to dig grave 40. Cradles 80 are used at other times, when moved into position along tracks 82, to support vault V and/or other items within opening 40.

FIG. 9 shows system 10 in a transport position, ready to be towed by a tow vehicle (not shown). Outriggers O are in their fully retracted position, and tongue T is in its extended position. Dirt boxes 32 are in their upright, generally vertical position, and boom B is in its retracted position, as is also hoist H. Boom B can be extended and retracted with respect to frame F by an actuator (not shown), which can be a hydraulic or pneumatic cylinder, a geared drive, chain and sprocket drive, etc. Backhoe 46 is also in a configuration where its lower and upper arms, and bucket 76 are in a retracted position. When system 10 is in a self-propelled configuration, wheel locks (not shown) are actuated, manually, or by remote control, to lock each driven wheel to its respective drive motor, such that the rotational output of such drive motor will be drive such driven wheel. However, when system 10 is to be towed, such locks are disengaged, so that the driven wheels can freewheel with respect to its drive motor, thereby facilitating towing of system 10. System 10 may include electric and/or hydraulic brakes which could be operated by a power system on board system 10 and/or the tow vehicle, if desired, to facilitate braking during towing and during operation of system 10 in its self-propelled mode.

FIG. 10 illustrates system 10, from the side, being used to dig a grave. As discussed above, backhoe 46 is used to remove soil from the earth, and such removed soil is deposited by the backhoe into the dirt boxes 32.

In one example of operation, one of various preferred embodiments of system 10 can be operated to accomplish the burial of a person's remains. For example, in the instance where a vault is ready for transport and burial at a grave site, an operator could lock the wheel hubs of the wheels W of system 10 in order that the wheel drive motors are operable to drive the wheels of system 10. During transport of system 10 over the road, as system 10 is towed by a tow vehicle (not shown), the wheels are preferably unlocked, to allow them to freewheel.

After locking the wheel hubs, the operator could proceed to configure system 10 for pick up of the vault V. This can involve system 10 approaching the vault such that the forward end of system 10 is near the vault. The operator may extend the outriggers O for stabilizing system 10 and extend the boom 18 to a position over the vault. Then, using the hoist H, the operator connects the hook 67 to a chain and/or strapping arrangement S configured about the vault for allowing pick up thereof. The operator would activate the hoist to lift the vault, and then retract the boom such that the vault is moved rearwardly within system 10. Once in such position, the vault is lowered onto the cradles 80, which are pre-positioned in place for supporting the vault. As discussed above, the cradles are movable for allowing the backhoe 46, or other excavator, to dig the grave through central opening 40 and for ultimately allowing the vault to be lowered into the grave. Preferably, once the vault is in place resting on the cradles, the vault is fixed in place using straps, chains, ropes, cables, or the like (none shown).

System 10 can then propel itself to transport the vault using its motor M and wheel motors, or, system 10 can be towed by a tow vehicle (not shown) over the road to another location, such as a cemetery. In the event system 10 is to be towed while holding vault V, wheels W can be unlocked to allow them to freewheel during towing. Once system 10 is towed to the desired location, it is detached from the tow vehicle, and its tongue portion T is preferably pivoted upwardly and fixed in such upward position to facilitate the maneuverability of system 10 as it is driven about.

When system 10 is to be operated in its self-propelled mode, the operator may sit in seat 50, and using controls 42, the operator may drive system 10 by manipulating the drive controls in a manner similar to how a bulldozer, skidsteer loader, excavator, etc. is driven. Although not shown, other steering devices such as a steering wheel, electronic steering, etc. could also be used. This driving arrangement, or structure, provides for a generally "zero radius turning" capability, with one control controlling the left side drive wheels, and another control controlling the right side wheels.

If a grave is to be dug, system 10 may be driven to the grave site and positioned such that the center opening 40 thereof is over the location of the grave to be dug. The operator could extend the outriggers O, and also lower dirt bins, or boxes, 32 to their generally horizontal position. The operator can unfasten the vault, by removing such straps, chains, or other fixation devices used for fixing the vault in place during transport. The vault would then be raised by the hoist H such that it was above and clears the cradles. The boom 18 would be extended, such that the vault can be moved outwardly from the central passage 40 and beyond the area of earth where the grave is to be dug. In order to clear central passage 40 for digging the grave, the cradles are moved out of the way on tracks 82, to a position generally removed from the area of earth in which the grave is to be dug.

Once the central passage 40 has been cleared, the excavator, or backhoe, 46 can then be used to dig the grave, with the operator manipulating the controls for the digging bucket to remove the earth necessary to dig the grave. The dirt removed during the digging process is dumped into the dirt bins 32 on either side of system 10 (the lids, or covers, 48 of such dirt bins having previously been opened). In order to maintain weight balance, the operator could, using the backhoe, dump earth into the left side and right side dirt bins 32 in alternating manner once the grave has been dug.

During digging, the vault is preferably positioned slightly above contact with the ground, to thereby keep tension in the hoist system H, such that vault V acts as a counterweight to balance system 10 during the digging operation. Once the grave has been dug, the boom and hoist H are activated to move the vault rearwardly and to then lower it into the grave.

Upon the casket has been placed in the vault V, and the vault covered with its lid, backfilling of the grave is done. The dirt bins 32 are pivoted to the dumping position in order to backfill the grave G with the dirt therein. The operator may use the bucket of the backhoe to pack or tamp down the dirt in the grave to the desired compaction level. Note that prior to moving the bins 32 to the dumping position, the bin covers are preferably closed, and once the desired amount of dirt has been dumped from such bins, the dirt bins are moved to the vertical position as show in FIG. 9, with the dirt being held therein by the covers 48.

After the burial and backfilling have been completed, the outriggers O can be retracted, and the operator can drive system 10 to another grave site, back to the tow vehicle, etc., transporting any excess dirt in the dirt bins. Once at the tow vehicle, the tongue T can be pivoted to its horizontal, towing position, and recoupled to the tow vehicle. Upon the wheels W of system 10 being unlocked, to allow them to free wheel during towing, and system 10 otherwise secured for towing, system 10 may be towed from the site by the tow vehicle to another location.

It is to be noted that system 10 is not limited to use in digging graves, but could be readily used and configured for use for a variety of other purposes. For example, system 10 could be used for burying other equipment, such as pipes, valves, sensors, etc. Use of system 10 in such instances could potentially afford benefits in labor and/or equipment cost savings.

As can be seen from the foregoing, at least one preferred embodiment of the present invention includes a system for digging a grave at a grave site, and includes an elongated frame which defines a frame opening of an area generally at least as large as the area of the grave and that is positioned over the grave site. A motor is connected to the frame, and wheels connected to the frame allow for movement of the frame about a surface, with the motor being connected to the wheels for selectively providing motive force to the wheels to move the frame about such surface. Also connected to the frame is an excavator configured for generally digging the grave via operation in the frame opening.

The foregoing system for digging a grave may also include a hoist attached to the frame that lifts and lowers a container within the grave.

Also, the foregoing system for digging a grave may include outriggers for stabilizing the frame during operation of the hoist and of the excavator.

Further, the foregoing system for digging a grave may also include at least one container for receiving dirt excavated by the excavator and for holding such dirt as the frame is moved about the surface.

Additionally, the foregoing system for digging a grave may include a generally zero radius turn structure connected to the wheels that allows the frame to make a generally zero radius turn when moving about a surface.

As can also be seen from the foregoing, at least one preferred embodiment of the present invention includes a method of digging a grave at a grave site comprising positioning a opening, defined by a frame, of an area generally at least as large as the area of the grave over the grave site, and digging the grave via the opening using an excavator connected to the frame. The method further includes lowering a container into the grave using a hoist connected to the frame.

The foregoing method may also include placing dirt generated during the excavation of the grave in a container attached to the frame and dumping the dirt from the container to backfill the grave.

While preferred embodiments of the invention have been described using specific terms, such descriptions are for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the present disclosure.

The invention claimed is:

1. A system for digging a grave in the soil at a grave site and for placing a container in the grave, the system comprising:

a frame defining a frame opening positionable over the grave site;

at least one wheel connected to said frame and to said motor that allows for movement of said frame upon the surface of the soil;

a motor connected to said frame and drivingly connected to said at least one wheel;

a steering mechanism connected to said at least one wheel that allows said frame to be maneuvered through a generally zero radius turn upon the surface of the soil;

an excavator connected to said frame that moves through said frame opening to dig the grave;

a hoist connected to said frame that lifts the container and lowers the container through said frame opening to within the grave;

at least one container connected to said frame that receives a substantial portion of the soil excavated by said excavator during digging of the grave; and at least one outrigger connected to said frame that contacts the surface of the soil to stabilize said frame.

2. A method for digging a grave in the soil at a grave site and for placing a container in the grave, the system comprising:

providing a frame defining an frame opening positionable over the grave site, said open frame having a plurality of wheels attached thereto;

providing a steering mechanism connected to said plurality of wheels that allows said frame to be maneuvered through a generally zero radius turn upon the surface of the soil;

providing an excavator connected to said frame that moves through said frame opening;

using said excavator to substantially dig the grave through said frame opening;

providing a hoist connected to said frame;

using said hoist to lift the container and to lower the container through said frame opening to within the grave;

providing at least one soil container connected to said frame; and using said excavator to deliver to said soil container a substantial portion of the soil excavated by said excavator during said digging of the grave.

3. The method as set forth in claim 2, further comprising:

providing an elongated boom attached to said frame; and using said hoist to extend the container outwardly along said boom substantially beyond said frame opening prior to said digging of the grave by said excavator.

4. The method as set forth in claim 2, further comprising:

positioning said soil container substantially horizontally during said delivery of said excavated soil thereto;

pivoting said soil container substantially vertically after said delivery of said excavated soil thereto; and storing said soil in said soil container.

5. The method as set forth in claim 2, further comprising:

positioning said soil container substantially horizontally during said delivery of said excavated soil thereto;

pivoting said soil container substantially vertically after said delivery of said excavated soil thereto; and dumping said soil from said soil container into the grave dug by said excavator.

6. A system for digging a grave in the soil at a grave site and for placing a container in the grave, the system comprising:

a frame defining a frame opening positionable over the grave site;

at least one wheel connected to said frame and to said motor that allows for movement of said frame upon the surface of the soil;

at least one motor connected to said frame and drivingly connected to said at least one wheel;

a steering mechanism connected to said at least one wheel that allows said frame to be maneuvered through a generally zero radius turn upon the surface of the soil;

an excavator connected to said frame that moves through said frame opening to dig the grave;

a hoist connected to said frame that lowers the container through said frame opening to within the grave; and at least one soil container connected to said frame that receives a substantial portion of the soil excavated by said excavator during digging of the grave.

7. The system as defined in claim 6, further comprising:

said soil container being pivotally attached to said frame and pivotable between a substantially horizontal position and a substantially vertical position.

8. The system as defined in claim 6, further comprising:

said at least one soil container including a first soil container on one side of said frame opening and a second soil container on a side of said frame opening opposite said first soil container; and said first soil container and said second soil container each being pivotally attached to said frame for pivoting between a substantially horizontal position and a substantially vertical position.

9. The system as defined in claim 6, further comprising:

a boom connected to said frame that allows said hoist to extend outwardly beyond said frame opening.

10. The system as defined in claim 6, further comprising:

at least one cradle spanning across said frame opening and slidingly carried upon said frame;

said cradle being configured to move between a first position for supporting said container substantially above said frame opening and a second position for allowing generally unimpeded access of said excavator to said frame opening.

11. The system as defined in claim 6, further comprising:

said at least one wheel including six wheels; and said at least one motor including six motors, each drivingly connected to one of said six wheels.

12. The system as defined in claim 6, further comprising:

said soil container being pivotally attached to said frame and pivotable between a substantially horizontal position and a substantially vertical position; and an actuator connected to said soil container that pivots said soil container from said substantially horizontal position to said substantially vertical position.

13. A system for digging a grave in the soil at a grave site and for placing a container in the grave, the system comprising:

a frame defining a frame opening positionable over the grave site;

a plurality of wheels connected to said frame and to said motor that allows for movement of said frame upon the surface of the soil;

at least one motor drivingly connected to each of said plurality of wheels;

a steering mechanism connected to said at least one wheel that allows said frame to be maneuvered through a generally zero radius turn upon the surface of the soil;

an excavator connected to said frame that moves through said frame opening to dig the grave;

a hoist connected to said frame that lowers the container through said frame opening to within the grave;

a boom connected to said frame and that allows said hoist to extend outwardly beyond said frame opening;

at least one cradle spanning across said frame opening and slidingly carried upon said frame;

said cradle being configured to move between a first position for supporting said container substantially above said frame opening and a second position for allowing generally unimpeded access of said excavator to said frame opening;

a first soil container on one side of said frame opening and a second soil container on a side of said frame opening opposite said first soil container;

said first soil container and said second soil container each being pivotally attached to said frame for pivoting between a substantially horizontal position and a substantially vertical position; and at least one actuator that pivots said first soil container and said second soil container from said substantially horizontal position to said substantially vertical position.

* * * * *